US011215366B2

(12) United States Patent
Folkers et al.

(10) Patent No.: US 11,215,366 B2
(45) Date of Patent: Jan. 4, 2022

(54) INWARDLY FIRING PREMIX GAS BURNER

(71) Applicant: BEKAERT COMBUSTION TECHNOLOGY B.V., Assen (NL)

(72) Inventors: Geert Folkers, Bruchterveld (NL); Dirk Ten Hoeve, Ruinerwold (NL); Arnoldus Martinus Van Wijk, Assen (NL); Jelmer Dorschman, Groningen (NL)

(73) Assignee: BEKAERT COMBUSTION TECHNOLOGY B.V., Assen (NL)

( * ) Notice: Subject to any disclaimer, the term of this patent is extended or adjusted under 35 U.S.C. 154(b) by 209 days.

(21) Appl. No.: 16/482,413

(22) PCT Filed: May 15, 2018

(86) PCT No.: PCT/EP2018/062512
§ 371 (c)(1),
(2) Date: Jul. 31, 2019

(87) PCT Pub. No.: WO2018/215241
PCT Pub. Date: Nov. 29, 2018

(65) Prior Publication Data

US 2019/0353345 A1 Nov. 21, 2019

(30) Foreign Application Priority Data

May 24, 2017 (EP) ..... 17172744

(51) Int. Cl.
*F23C 3/00* (2006.01)
*F23R 3/28* (2006.01)
*F23D 14/14* (2006.01)

(52) U.S. Cl.
CPC ..... *F23R 3/286* (2013.01); *F23D 14/145* (2013.01)

(58) Field of Classification Search
CPC ..... F23R 3/286; F23D 14/145
(Continued)

(56) References Cited

U.S. PATENT DOCUMENTS 2,255,298 A 9/1941 Reichhelm
3,277,564 A 10/1966 Webber et al.
(Continued)

FOREIGN PATENT DOCUMENTS

EP 1 616 128 1/2006
EP 2 713 105 4/2014
WO 2014/167270 10/2014

OTHER PUBLICATIONS

International Search Report dated Jul. 9, 2018 in International Application No. PCT/EP2018/062512.
(Continued)

*Primary Examiner* — Avinash A Savani
(74) *Attorney, Agent, or Firm* — Wenderoth, Lind & Ponack, L.L.P.

(57) ABSTRACT

A premix gas burner comprises a main body, a porous wall, a distribution chamber delimited by the main body and by the porous wall, and an entrance in the main body for introducing a premix of combustible gas and air into the distribution chamber. The main body comprises a cylindrical shape. The porous wall comprises a first porous wall segment and a second porous wall segment. The first porous wall segment and the second porous wall segment both comprise pores for the premix gas to flow from the distribution chamber through the pores, for combustion of the premix gas outside the distribution chamber. The first porous wall segment comprises or consists out of a shaped segment. The shaped segment is directed to the inside of the distribution chamber, such that when the burner is in use premix gas flows from the distribution chamber through the pores of the shaped segment to the inside of the shaped segment. The
(Continued)

second porous wall segment comprises an annular porous wall segment. The annular porous wall segment is provided at the base of the shaped segment. The base of the shaped element is provided at the side of the shaped element opposite to the location of the entrance in the main body.

18 Claims, 3 Drawing Sheets

(58) Field of Classification Search
USPC ..... 431/353, 116, 329
See application file for complete search history.

(56) References Cited

U.S. PATENT DOCUMENTS 3,394,213 A 7/1968 Roberts et al.
4,624,631 A * 11/1986 Kobayashi ..... F23D 11/40 431/9
4,846,716 A * 7/1989 Courrege ..... F23D 14/08 431/263
4,930,199 A 6/1990 Yanagisawa
5,087,270 A * 2/1992 Gateau ..... C01B 3/386 48/127.9
5,203,689 A * 4/1993 Duggan ..... F23D 14/74 122/17.1
5,458,484 A * 10/1995 Ripka ..... F23D 14/02 126/109
5,782,629 A * 7/1998 Lannutti ..... F23D 14/16 431/326
6,461,150 B1 * 10/2002 Sirand ..... F24C 1/08 431/329

OTHER PUBLICATIONS

Written Opinion of the International Searching Authority dated Jul. 9, 2018 in International Application No. PCT/EP2018/062512.

* cited by examiner

INWARDLY FIRING PREMIX GAS BURNER

The invention relates to the field of inwardly firing premix gas burners that can e.g. be used in two pass boilers.

BACKGROUND ART

In two pass boilers, a burner produces a longitudinal flame in a combustion chamber. The flow of the gaseous combustion products hits a wall of the combustion chamber opposite to the location of the burner. The flow of gaseous combustion products is reversed. The flue gas flows along the walls of the—mostly cylindrical—combustion chamber; and an exit of the gaseous combustion products is provided at the side of the combustion chamber where the burner is located.

WO2014/167270A1 and EP2713105A1 disclose burners that are suited for two pass boilers.

The burner disclosed in EP2713105A1 has a main body adapted to receive a fuel gas-air mixture. On the main body a conical surface is provided having a series of openings, through which the fuel gas-air mixture flows from an internal distribution chamber of the main body to a combustion area outside the main body, in a manner so as to develop a longitudinal flame.

DISCLOSURE OF INVENTION

The first aspect of the invention is a premix gas burner comprising a main body, a porous wall, a distribution chamber delimited by the main body and by the porous wall, and an entrance in the main body for introducing a premix of combustible gas and air into the distribution chamber. The main body comprises a cylindrical shape. The porous wall comprises a first porous wall segment and a second porous wall segment. The first porous wall segment and the second porous wall segment both comprise pores for the premix gas to flow from the distribution chamber through the pores for combustion of the premix gas outside the distribution chamber. The first porous wall segment comprises or consists out of a shaped segment. The shaped segment is directed to the inside of the distribution chamber, such that when the burner is in use premix gas flows from the distribution chamber through the pores of shaped segment to the inside of the shaped segment. The second porous wall segment comprises an annular porous wall segment. The annular porous wall segment is provided at the base of the shaped segment. The base of the shaped elements is provided at the side of the shaped element opposite to the location of the entrance in the main body.

Prior art premix burners for two pass boilers have shown to be prone to flame instability, as combustion can become unstable—even leading to flame lift off—when gas and or air supply to the burner varies; especially when varying the amount of excess combustion air in the premix. The premix gas burner of the invention has the surprising benefit that a stable combustion is obtained even when gas or air supply to the burner varies. It seems that the presence of the annular porous wall segment at the base of the shaped segment of the first porous wall segment creates a stabilization of the flames of the burner.

Surprisingly, the burner also has a larger modulation range in which stable combustion is obtained.

The shaped segment can e.g. have a conical shape, a frusto-conical shape, a pyramidal shape (e.g. with 6 or 7 sides), a frusto-pyramidal shape (e.g. with 6 or 7 sides), or a surface obtained by rotation of a part of an ellipse around a center line.

Preferably, the second porous wall segment is provided around the shaped segment of the first porous segment.

In a preferred embodiment, the second porous wall segment comprises around the circumference of the burner a plurality of segments, wherein the segments comprise porous segments alternated with segments that are impervious to premix gas.

Preferably, the base of the shaped segment is provided at the cross section of the shaped segment that has the largest diameter.

Preferably, the shaped segment comprises or consists out of a conical or frusto-conical shape. The conical or frusto-conical shape is directed to the inside of the distribution chamber; such that when the burner is in use premix gas flows from the distribution chamber through the pores of the conical or frusto-conical shape segment to the inside of the conical or frusto-conical shape segment. More preferably, the width of the annular porous wall segment is at least 0.075 times the largest diameter of the segment with conical or frusto-conical shape of the first porous wall segment; as an example the width of the flat annular porous wall segment can be 0.1 times the largest diameter of the conical shape of the segment with conical shape. The annual porous wall segment can e.g. be a flat annular porous wall segment, more preferably provided perpendicularly to the axis of the shaped segment.

Embodiments in which the shaped segment comprises or consists out of frusto-conical shape have shown to provide more reliable burners. Preferably, the smallest cross sectional diameter of the frusto-conical shape is more than 18 mm; preferably more than 20 mm; and preferably less than 30 mm. Preferably, the closing section of the frusto-conical shape is impermeable to premix gas and consequently, does not function as burner deck when the burner is in use.

In embodiments wherein the shape segment comprises or consists out of a conical or frusto-conical shape, preferably the conical shape of the segment with conical or frusto-conical shape of the first porous wall segment has a cone angle more than 60°; and preferably less than 80°. E.g. a 70° cone angle can advantageously be used.

In a preferred embodiment, the annular porous wall segment comprises or consists out of a flat annular porous wall segment. More preferably, the flat annular porous wall segment is perpendicular to the axis of the premix gas burner.

In a preferred embodiment, the width of the flat annular porous wall segment is at least 0.075 times the largest diameter of the shaped segment of the first porous wall segment.

In a preferred embodiment, the annular porous wall segment is not flat.

In a preferred embodiment, the annular porous wall segment comprises or consists out of a segment with frusto-conical shape. More preferably, the cone angle of the segment of the annular porous wall segment with frusto-conical shape has a cone angle larger than 120°.

In a preferred embodiment wherein the shaped segment comprises or consists out of a conical or frusto-conical shape; and wherein the annular porous wall segment comprises or consists out of a segment with frusto-conical shape; the annular porous wall segment comprises or consists out of a segment with frusto-conical shape with cone angle larger than or equal to the largest cone angle of the segment with conical or frusto-conical shape of the first porous wall segment. Preferably, the cone angle of the segment of the annular porous wall segment with frusto-conical shape has a cone angle larger than 120°.

Preferably, the annular porous wall segment comprises a perforated plate, a woven wire mesh or an expanded metal sheet. More preferred, the annular porous wall segment comprises a woven, knitted or braided burner deck comprising metal fibers (and preferably consisting out of metal fibers) covering the perforated plate, woven wire mesh or expanded metal sheet. More preferably, the metal fibers are stainless steel fibers. More preferably, the woven, knitted or braided burner deck comprises yarns comprising in their cross section a plurality of metal fibers. The woven, knitted or braided burner deck is provided for anchoring flames onto the annular porous wall segment.

In embodiments wherein the annular porous wall segment comprises a perforated plate, a woven wire mesh or an expanded metal sheet; preferably the gas permeable area of the perforated plate, woven wire mesh or expanded metal sheet of the annular porous wall segment is less than 7% of its total area; and preferably less than 5%. Advantageously, a permeable area of 4% can be used. With gas permeable area is meant the sum of the surface area of the pores of the perforated plate, woven wire mesh or expanded metal sheet.

Preferably, the shaped segment of the first porous wall segment comprises a perforated plate, a woven wire mesh or an expanded metal sheet shaped into the shape of the shaped element. More preferably, the gas permeable area of the perforated plate, woven wire mesh or expanded metal sheet of the shaped segment is more than 30%, more preferably more than 40%, of its total area. With gas permeable area is meant the sum of the surface area of the pores of the perforated plate, woven wire mesh or expanded metal sheet.

In preferred embodiments wherein the shaped segment of the first porous wall segment comprises a perforated plate, a woven wire mesh or an expanded metal sheet shaped into conical shape, the perforated plate, woven wire mesh or expanded metal sheet of the shaped segment is covered at the inner side of the conical shape by a woven, knitted or braided burner deck comprising metal fibers; and preferably consisting out of metal fibers. More preferably, the woven, knitted or braided burner deck comprises or consists out of yarns comprising in their cross section a plurality of metal fibers.

In preferred embodiments wherein the annular porous wall segment comprises a perforated plate, a woven wire mesh or an expanded metal sheet; and wherein the shaped segment of the first porous wall segment comprises a perforated plate, a woven wire mesh or an expanded metal sheet shaped into shape; the relative gas permeable area of the perforated plate, woven wire mesh or expanded metal sheet of the shaped segment of the first porous wall segment is higher than the relative gas permeable area of the perforated plate, woven wire mesh or expanded metal sheet of the annular porous wall segment. With relative gas permeable area is meant the gas permeable area—which is the sum of the surface area of the pores—as a percentage of the total area of a surface. More preferably, the relative gas permeable area of the perforated plate, woven wire mesh or expanded metal sheet of the shaped segment of the first porous wall segment is more than 3 times, more preferably more than 5 times, more preferably more than 7 times, the relative gas permeable area of the perforated plate, woven wire mesh or expanded metal sheet of the annular porous wall segment.

In preferred embodiments, the woven, knitted or braided burner deck comprising or consisting out of metal fibers is one layer of a woven, knitted or braided fabric, placed on the perforated plate, woven wire mesh or expanded metal sheet.

In a preferred embodiment, the burner deck is knitted, woven or braided using yarns comprising or consisting out of a plurality of metal filaments or metal staple fibers or metal monofilaments.

Examples of preferred metal fibers for use in the invention are stainless steel fibers. A specifically preferred range of stainless steel fibers are chromium and aluminum comprising stainless steel fibers as in DIN 1.4767, e.g. as are known under the trademark FeCrAlloy. Preferred are metal fibers with equivalent diameter of less than 50 μm, more preferably less than 40 μm. With equivalent diameter of a fiber is meant the diameter of a circle with the same surface area as the cross sectional area of that fiber.

Preferred metal fibers for use in the invention, e.g. stainless steel fibers, with an equivalent diameter less than 50 micrometer or less than 40 micrometer, e.g. less than 25 micrometer, can be obtained by a bundle drawing technique. This technique is disclosed e.g. in U.S. Pat. Nos. 2,050,298, 3,277,564 and in U.S. Pat. No. 3,394,213. Metal wires are forming the starting material and are covered with a coating such as iron or copper. A bundle of the covered wires is subsequently enveloped in a metal pipe. Thereafter the thus enveloped pipe is reduced in diameter via subsequent wire drawing steps to come to a composite bundle with a smaller diameter. The subsequent wire drawing steps may or may not be alternated with an appropriate heat treatment to allow further drawing. Inside the composite bundle the initial wires have been transformed into thin fibers which are embedded separately in the matrix of the covering material. Such a bundle preferably comprises not more than 2000 fibers, e.g. between 500 and 1500 fibers. Once the desired final diameter has been obtained the covering material can be removed e.g. by solution in an adequate leaching agent or solvent. The result is a bundle of metal fibers.

Alternatively metal fibers for use in the invention, such as stainless steel fibers, can be manufactured in a cost effective way by machining a thin plate material. Such a process is disclosed e.g. in U.S. Pat. No. 4,930,199. A strip of a thin metal plate or sheet is the starting material. This strip is wound a number of times around a rotatably supported main shaft and is fixed thereto. The main shaft is rotated at constant speed in a direction opposite to that in which the plate material is wound. A cutter having an edge line extending perpendicularly to the axis of the main shaft is fed at constant speed. The cutter has a specific face angle parallel to the axis of the main shaft. The end surface of the plate material is cut by means of the cutter.

Yet an alternative way of producing metal fibers for use in the invention is via extraction or extrusion from a melt of a metal or metal alloy.

Another alternative way of producing metal fibers for use in the invention is machining fibers from a block of solid metal.

Yarns, comprising or consisting out of metal fibers, for the production of the knitted fabric, the braided fabric or the woven fabric for use as burner deck in the invention can e.g. be spun from stretch broken fibers (such as bundle drawn stretch broken fibers) and/or can e.g. be yarns made from shaved or machined fibers. The yarns can be plied yarns, e.g. two ply, three ply . . . . Preferred fabrics made from metal fibers have a specific weight between 0.6 and 3 $kg/m^2$; preferably between 0.7 and 3 $kg/m^2$, even more preferred between 1.2 and 2.5 $kg/m^2$.

In a preferred embodiment wherein a woven, knitted or braided burner deck comprising metal fibers is provided, the knitted fabric, the braided fabric or the woven fabric has a specific weight between 0.6 and 1.3 kg/m$^2$, more preferably between 0.6 and 0.9 kg/m$^2$.

A preferred premix gas burner comprises an ignition electrode. The ignition electrode is positioned such that ignition of the burner occurs on the annular porous wall segment.

A preferred premix gas burner comprises an ionization electrode for flame sensing and/or for combustion control. The ionization electrode is positioned such that ionization current is determined or measured at the annular porous wall segment.

In a preferred premix gas burner, the shaped element widens in the direction away from the entrance in the main body.

In a preferred premix gas burner, the cylindrical shape of the main body comprises a perforated section. The perforated section is covered by a woven, knitted or braided burner deck comprising metal fibers. The woven, knitted or braided burner deck provides an extended burner deck for anchoring of flames when the burner is in use. The perforated section can be provided along part of the circumference of the cylindrical shape of the main body, or preferably along the full circumference of the cylindrical shape of the main body. In embodiments of the invention, the perforated section is provided along part of the circumference of the cylindrical shape of the main body whereas the woven, knitted or braided cloth—providing the burner deck at the perforated section—is provided along the full circumference of the cylindrical shape of the main body. Preferably, the perforated section is only provided along part of the height of the cylindrical shape of the main body. Preferably, the perforated section neighbours the annular porous wall segment, such that a continuous burner deck is provided on the burner. The provision of the extended burner deck has the benefit that a very convenient burner deck is provided onto which an ignition pen and/or an ionization pen can be installed. Preferably, the relative gas permeable area of the perforated section of the cylindrical shape of the main body is higher than the relative gas permeable area of the of the perforated plate, woven wire mesh or expanded metal sheet of the annular porous wall segment. More preferably, the relative gas permeable area of the perforated plate, woven wire mesh or expanded metal sheet of the shaped element of the first porous wall segment is higher than the relative gas permeable area of the perforated plate, woven wire mesh or expanded metal sheet of the annular porous wall segment.

The second aspect of the invention is a premix gas combustion system comprising a combustion chamber having lateral walls; and a premix gas burner as in any embodiment of the first aspect of the invention. The premix gas burner is provided at a first longitudinal end of the combustion chamber. The second longitudinal end of the combustion chamber is closed by a wall. The combustion chamber is provided for the combustion of the premix gas after the premix gas has flown from the distribution chamber through the pores of the porous wall. An exit for combustion gas is provided in the combustion chamber at the first longitudinal end of the combustion chamber.

Preferably, the exit for combustion gas is provided in a ring around the premix gas burner.

Preferably, the combustion chamber has an axial symmetry around its central axis.

The third aspect of the invention is a boiler comprising a premix gas burner as in any embodiment of the first aspect of the invention; or a premix gas combustion system as in any embodiment of the second aspect of the invention.

The fourth aspect of the invention is a method for operating a premix gas burner as in any embodiment of the first aspect of the invention; or for operating a premix gas combustion system as in any embodiment of the second aspect of the invention. The burner operates at a capacity of more than 200 kW, preferably more than 500 kW, more preferably more than 1000 kW; even more preferably more than 2000 kW.

The fifth aspect of the invention is a method for operating a premix gas burner as in any embodiment of the first aspect of the invention; or for operating a premix gas combustion system as in any embodiment of the second aspect of the invention. The surface load of the shaped segment is more than 50 kW/dm$^2$; preferably more than 65 kW/dm$^2$. With surface load is meant the load (in kW) of the shaped segment divided by the surface area of the shaped segment.

MODE(S) FOR CARRYING OUT THE INVENTION

Figure 1:
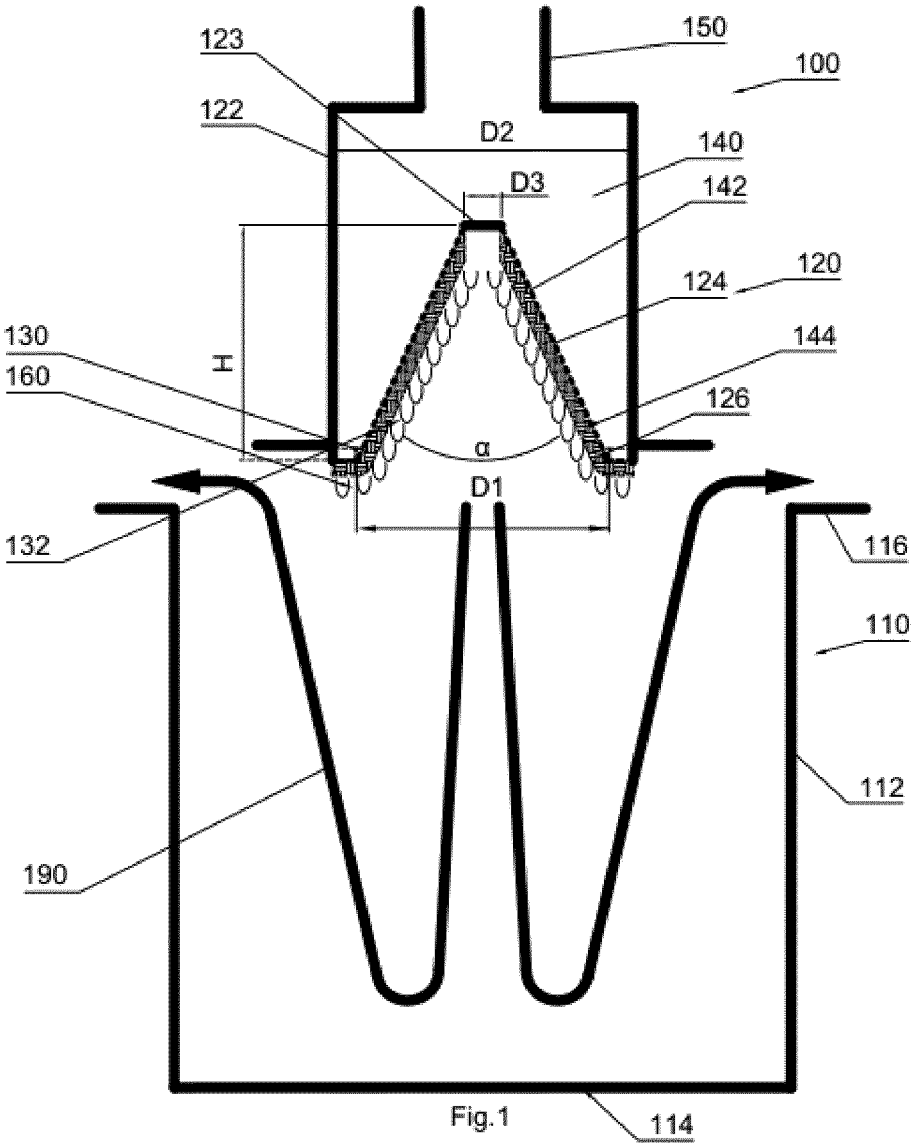
FIG. 1 shows a premix gas combustion system according to the invention.

FIG. 1 shows a premix gas combustion system 100 according to the invention. The system 100 comprises a cylindrical combustion chamber 110 having lateral walls 112 and a premix gas burner 120 as in the first aspect of the invention. The premix gas burner 120 is provided at a first longitudinal end of the combustion chamber 110. The second longitudinal end 114 of the combustion chamber is closed by a wall.

The premix gas burner 120 comprises a cylindrical main body 122, a porous wall 124, 126, a distribution chamber 140 delimited by the main body and by the porous wall, and an entrance 150 in the main body for introducing a premix of combustible gas and air into the distribution chamber. The porous wall comprises a first porous wall segment 124 and a second porous wall segment 126.

The first porous wall segment 124 is provided by a segment with frusto-conical shape 124. The frusto-conical shape is directed to the inside of the distribution chamber; such that when the burner is in use premix gas flows from the distribution chamber through the pores of the frusto-conical shape segment to the inside of the frusto-conical shape segment. The closing section 123 of the frusto-conical shape is impermeable to premix gas. The conical part of the frusto-conical shape has an angle $\alpha$ (the cone angle), which can e.g. be 70°. The segment with frusto-conical shape 124 comprises a perforated plate 142 shaped into conical shape; as an example 36% of the surface of the perforated plate 142 is permeable to premix gas. The perforated plate 142 is covered at the inner side of the frusto-conical shape by a knitted burner deck 144 comprising yarns. The yarns comprise a plurality of metal fibers in their cross section. Alternatively, the perforated plate can e.g. be covered at the inner side of the frusto-conical shape by a braided or woven burner deck comprising metal fibers.

The second porous wall segment is provided by a flat annular porous wall segment 126 provided at the base of the segment with conical shape. In the example in FIG. 1, the flat annular porous wall segment comprises a perforated plate 130, the gas permeable area of the perforated plate is less than 7% of its total area; e.g. 5% of its total area is permeable to gas. The perforated plate 130, covered by a knitted fabric 132 comprising metal fibers acts as burner deck. The knitted burner deck is provided for anchoring the flames 160 onto the flat annular porous wall segment.

The combustion chamber is provided for the combustion of the premix gas after the premix gas has flown from the distribution chamber through the pores of the porous wall. Flames 160 are formed on the surface of the first porous wall segment and on the surface of the second porous wall segment. An exit 116 for combustion gas is provided in the combustion chamber at the first longitudinal end of the combustion chamber. The flow of the flue gas created by the combustion is schematically shown by flow lines 190.

The premix gas burner can comprise an ignition electrode (not shown in FIG. 1) positioned such that ignition of the burner occurs on the flat annular porous wall segment provided at the base of the segment with conical shape.

The premix gas burner can comprise an ionization electrode (not shown in FIG. 1) for flame sensing and/or for combustion control. The ionization electrode is preferably positioned such that ionization current is determined or measured at the flat annular porous wall segment provided at the base of the segment with conical shape.

Examples of dimensions (with reference to FIG. 1) of premix gas burners according to the invention and their nominal capacity are given in table I.

TABLE I

Dimensions of examples according to FIG. 1 of premix gas burners

| Capacity (kW) | Diameter $D_2$ (mm) | Diameter $D_1$ (mm) | Cone angle α (°) | Height H (mm) | Diameter $D_3$ (mm) |
|---|---|---|---|---|---|
| 500 | 200 | 168 | 68 | 125 | 24 |
| 700 | 245 | 200 | 71 | 140 | 24 |
| 1000 | 300 | 235 | 68 | 175 | 24 |
| 1400 | 350 | 285 | 71 | 200 | 24 |
| 3500 | 480 | 415 | 73 | 280 | 24 |

Such burner according to the invention has been tested at different surface load of the burner deck. The burner functioned well at a surface load of the burner deck 100 kW/dm$^2$ as well as at a surface load of the burner deck 2 kW/dm$^2$, evidencing the large modulation range of the burner.

Figure 2:
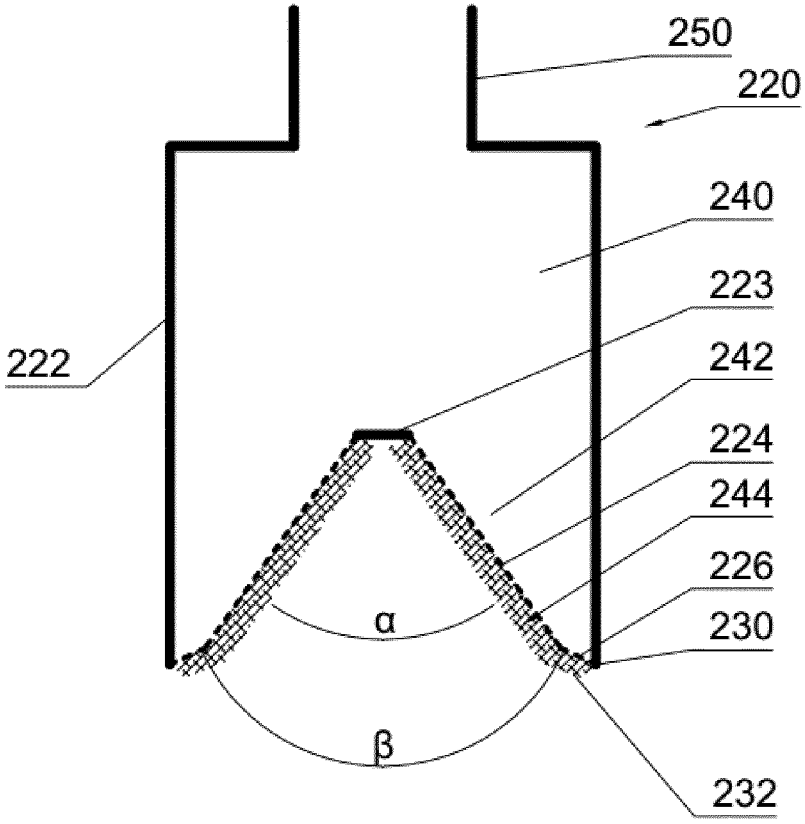
FIG. 2 shows a premix gas burner according to the invention.

FIG. 2 shows a premix gas burner 220 according to the invention. The premix gas burner 220 comprises a cylindrical main body 222, a porous wall 224, 226, a distribution chamber 240 delimited by the main body and by the porous wall, and an entrance 250 in the main body for introducing a premix of combustible gas and air into the distribution chamber. The porous wall comprises a first porous wall segment 224 and a second porous wall segment 226.

The first porous wall segment 224 is provided by a segment with frusto-conical shape 224. The frusto-conical shape is directed to the inside of the distribution chamber 240; such that when the burner is in use premix gas flows from the distribution chamber through the pores of the frusto-conical shape segment to the inside of the frusto-conical shape segment. The closing section 223 of the frusto-conical shape is impermeable to premix gas. The conical part of the frusto-conical shape has an angle α (the cone angle), which can e.g. be 70°. The segment with frusto-conical shape 224 comprises a perforated plate 242 shaped into conical shape. The perforated plate 242 is covered at the inner side of the frusto-conical shape by a knitted burner deck 244 comprising metal fibers. Alternatively, the perforated plate can e.g. be covered at the inner side of the frusto-conical shape by a braided or woven burner deck comprising metal fibers.

The second porous wall segment is provided at the base of the segment with conical shape; the second porous wall segment consists out of an annular segment. The annular segment is a segment 226 with frusto-conical shape with cone angle β larger than the largest cone angle α of the segment with conical shape of the first porous wall segment. The angle β is e.g. 130° whereas the angle α is e.g. 70°. In the example in FIG. 2, the annular porous wall segment comprises a perforated plate 230. The gas permeable area of the perforated plate is less than 7% of its total area. The perforated plate 230 is covered by a knitted fabric 232 comprising metal fibers acting as burner deck. The knitted burner deck is provided for anchoring the flames (not shown in FIG. 2) onto the annular porous wall segment when the burner is in use.

In the example of FIG. 2, the relative gas permeable area of the perforated plate of the segment with conical shape of the first porous wall segment is higher than the relative gas permeable area of the perforated plate of the annular porous wall segment.

Figure 3:
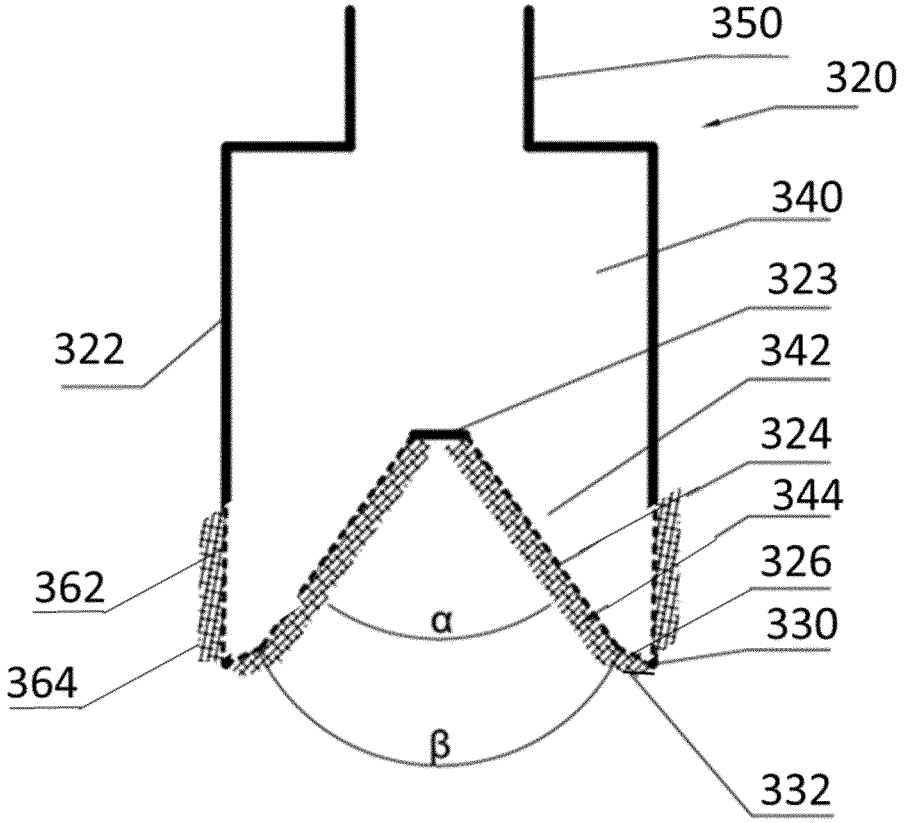
FIG. 3 shows another example of a premix gas burner according to the invention.

FIG. 3 shows a premix gas burner 320 according to the invention. The premix gas burner 320 comprises a cylindrical main body 322, a porous wall 324, 326, a distribution chamber 340 delimited by the main body and by the porous wall, and an entrance 350 in the main body for introducing a premix of combustible gas and air into the distribution chamber. The porous wall comprises a first porous wall segment 324 and a second porous wall segment 326.

The first porous wall segment 324 is provided by a segment with frusto-conical shape 324. The frusto-conical shape is directed to the inside of the distribution chamber 340; such that when the burner is in use premix gas flows from the distribution chamber through the pores of the frusto-conical shape segment to the inside of the frusto-conical shape segment. The closing section 323 of the frusto-conical shape is impermeable to premix gas. The conical part of the frusto-conical shape has an angle α (the cone angle), which can e.g. be 70°. The segment with frusto-conical shape 324 comprises a perforated plate 342 shaped into conical shape. The perforated plate 342 is covered at the inner side of the frusto-conical shape by a knitted burner deck 344 comprising metal fibers.

The second porous wall segment is provided at the base of the segment with conical shape. The second porous wall segment consists out of an annular segment. The annular segment is a segment 326 with frusto-conical shape with cone angle β larger than the largest cone angle α of the segment with conical shape of the first porous wall segment. The angle β is e.g. 130° whereas the angle α is e.g. 70°. In the example in FIG. 3, the annular porous wall segment comprises a perforated plate 330. The gas permeable area of the perforated plate is less than 7% of its total area. The perforated plate 330 is covered by a knitted fabric 332 comprising metal fibers acting as burner deck. The knitted burner deck is provided for anchoring the flames (not shown in FIG. 3) onto the annular porous wall segment when the burner is in use.

The cylindrical main body 322 comprises a perforated section 362 along the full circumference of the cylindrical main body. The perforated section is covered by a knitted burner deck 364 comprising metal fibers. This knitted burner deck 364 provides an extended burner deck for anchoring of flames when the burner is in use. The perforated section 362 neighbours the annular porous wall segment 326, such that a continuous burner deck is provided on the burner. The extended burner deck provided by the knitted burner deck 364 provides a very convenient location for the installation for an ignition pen to ignite the complete burner, or for the installation of an ionization pen to monitor combustion on the burner.

In the example of FIG. 3, the relative gas permeable area of the perforated plate of the segment with conical shape of the first porous wall segment is higher than the relative gas permeable area of the perforated plate of the annular porous wall segment; and the relative gas permeable area of the perforated section of the cylindrical shape of the main body is higher than the relative gas permeable area of the perforated plate of the annular porous wall segment.

The invention claimed is:

1. Premix gas burner, comprising a main body; wherein the main body comprises a cylindrical shape;

a porous wall;

a distribution chamber delimited by the main body and by the porous wall, an entrance in the main body for introducing a premix of combustible gas and air into the distribution chamber;

wherein the porous wall comprises a first porous wall segment and a second porous wall segment;

wherein the first porous wall segment and the second porous wall segment both comprise pores for the premix gas to flow from the distribution chamber through the pores for combustion of the premix gas outside the distribution chamber;

wherein the first porous wall segment comprises or consists out of a shaped segment, wherein the shaped segment is directed to the inside of the distribution chamber, such that when the burner is in use premix gas flows from the distribution chamber through the pores of shaped segment to the inside of the shaped segment;

wherein the second porous wall segment comprises an annular porous wall segment;

wherein the annular porous wall segment is provided at the base of the shaped segment;

wherein the base of the shaped element is provided at the side of the shaped element opposite to the location of the entrance in the main body.

2. Premix gas burner as in claim 1, wherein the shaped segment comprises or consists out of a conical or frusto-conical shape.

3. Premix gas burner as in claim 1, wherein the annular porous wall segment comprises or consists out of a flat annular porous wall segment.

4. Premix gas burner as in claim 1, wherein the annular porous wall segment is not flat.

5. Premix gas burner as in claim 1, wherein the annular porous wall segment comprises or consists out of a segment with frusto-conical shape.

6. Premix gas burner as in claim 2, wherein the annular porous wall segment comprises or consists out of a segment with frusto-conical shape, and wherein the annular porous wall segment comprises or consists out of a segment with frusto-conical shape with cone angle larger than or equal to the largest cone angle of the segment with conical or frusto-conical shape of the first porous wall segment.

7. Premix gas burner as in claim 1, wherein the annular porous wall segment comprises a perforated plate, a woven wire mesh or an expanded metal sheet.

8. Premix gas burner as in claim 7, wherein the annular porous wall segment comprises a woven, knitted or braided burner deck comprising metal fibers, covering the perforated plate, woven wire mesh or expanded metal sheet; and wherein the woven, knitted or braided burner deck is provided for anchoring flames onto the annular porous wall segment.

9. Premix gas burner as in claim 7, wherein the gas permeable area of the perforated plate, woven wire mesh or expanded metal sheet of the annular porous wall segment is less than 7% of its total area.

10. Premix gas burner as in claim 1, wherein the shaped segment of the first porous wall segment comprises a perforated plate, a woven wire mesh or an expanded metal sheet shaped into shape of the shaped element; and wherein the perforated plate, woven wire mesh or expanded metal sheet of the shaped segment of the first porous wall segment is covered at the inner side of the shaped segment by a woven, knitted or braided burner deck comprising metal fibers.

11. Premix gas burner as in claim 10, wherein the annular porous wall segment comprises a perforated plate, a woven wire mesh or an expanded metal sheet; and wherein the relative gas permeable area of the perforated plate, woven wire mesh or expanded metal sheet of the shaped segment of the first porous wall segment is higher than the relative gas permeable area of the perforated plate, woven wire mesh or expanded metal sheet of the annular porous wall segment.

12. Premix gas burner as in claim 1, wherein the shaped element widens in the direction away from the entrance in the main body.

13. Premix gas burner as in claim 1, wherein the cylindrical shape of the main body comprises a perforated section;

wherein the perforated section is covered by a woven, knitted or braided burner deck comprising metal fibers; and wherein the woven, knitted or braided burner deck provides an extended burner deck for anchoring of flames when the burner is in use.

14. Premix gas combustion system, comprising a combustion chamber having lateral walls; and a premix gas burner as in claim 1, wherein the premix gas burner is provided at a first longitudinal end of the combustion chamber;

wherein the second longitudinal end of the combustion chamber is closed by a wall;

wherein the combustion chamber is provided for the combustion of the premix gas after the premix gas has flown from the distribution chamber through the pores of the porous wall; and wherein an exit for combustion gas is provided in the combustion chamber at the first longitudinal end of the combustion chamber.

15. Method for operating a premix gas burner as in claim 1, wherein the burner operates at a capacity of more than 200 kW; and/or wherein the surface load of the shaped segment is more than 50 $kW/dm^2$.

16. Premix gas burner as in claim 1, wherein the annular porous wall segment comprises a perforated plate;

wherein the shaped segment of the first porous wall segment comprises a woven wire mesh shaped into shape of the shaped element;

wherein the woven wire mesh of the shaped segment of the first porous wall segment is covered at the inner side of the shaped segment by a woven, knitted or braided burner deck comprising metal fibers.

17. Premix gas burner as in claim 16, wherein the relative gas permeable area of the woven wire mesh of the shaped segment of the first porous wall segment is higher than the relative gas permeable area of the perforated plate of the annular porous wall segment.

18. Premix gas burner as in claim 16, wherein the annular porous wall segment comprises a woven, knitted or braided burner deck comprising metal fibers covering the perforated plate; and wherein the woven, knitted or braided burner deck is provided for anchoring flames onto the annular porous wall segment.

* * * * *